US009076620B2

(12) United States Patent
Lee

(10) Patent No.: US 9,076,620 B2
(45) Date of Patent: Jul. 7, 2015

(54) ELECTROMAGNETIC SWITCHING DEVICE

(71) Applicant: LSIS CO., LTD., Anyang-si, Gyeonggi-do (KR)

(72) Inventor: Sang Jin Lee, Daegu (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/078,306

(22) Filed: Nov. 12, 2013

(65) Prior Publication Data

US 2014/0232492 A1 Aug. 21, 2014

(30) Foreign Application Priority Data

Feb. 18, 2013 (KR) ..... 10-2013-0017219

(51) Int. Cl.

| | |
|---|---|
| ***H01H 67/02*** | (2006.01) |
| ***H01H 50/16*** | (2006.01) |
| ***H01H 50/30*** | (2006.01) |
| *H01H 50/34* | (2006.01) |

(52) U.S. Cl.

CPC ..... *H01H 50/163* (2013.01); *H01H 50/305* (2013.01); *H01H 50/34* (2013.01)

(58) Field of Classification Search

CPC ..... H01H 51/065
USPC ..... 335/126, 131
See application file for complete search history.

(56) References Cited

U.S. PATENT DOCUMENTS

| | | | | |
|---|---|---|---|---|
| 2,782,282 | A * | 2/1957 | Schrack | 335/281 |
| 3,470,504 | A * | 9/1969 | Mallory et al. | 335/78 |
| 8,179,217 | B2 * | 5/2012 | Kawaguchi et al. | 335/80 |
| 8,305,169 | B2 * | 11/2012 | Suzuki et al. | 335/126 |
| 8,674,796 | B2 * | 3/2014 | Ito et al. | 335/260 |
| 2011/0127747 | A1 | 6/2011 | Souschek et al. | |
| 2011/0140813 | A1 * | 6/2011 | Suzuki et al. | 335/156 |

FOREIGN PATENT DOCUMENTS

| | | |
|---|---|---|
| DE | 2639274 | 3/1978 |
| DE | 10360446 | 7/2004 |
| EP | 2442331 | 4/2012 |
| JP | 50-085762 | 7/1975 |
| JP | 07-153340 | 6/1995 |
| JP | 2006-185816 | 7/2006 |
| JP | 2010-257789 | 11/2010 |
| JP | 2013-016349 | 1/2013 |
| KR | 10-1072628 | 10/2011 |
| KR | 10-1116384 | 3/2012 |

OTHER PUBLICATIONS

Korean Intellectual Property Office Application Serial No. 10-2013-0017219, Office Action dated Feb. 13, 2014, 3 pages.

(Continued)

*Primary Examiner* — Alexander Talpalatski
(74) *Attorney, Agent, or Firm* — Lee, Hong, Degerman, Kang & Waimey

(57) ABSTRACT

Disclosed is an electromagnetic device. The electromagnetic switching device includes: a shaft coupled with a movable contact point to reciprocate up and down; and an elastic member coupled with a bottom end of the shaft, wherein a vertical volume of the elastic member expands as a temperature is increased.

5 Claims, 4 Drawing Sheets

(56) References Cited

OTHER PUBLICATIONS

Korean Intellectual Property Office Application Serial No. 10-2013-0017219, Notice of Allowance dated Apr. 15, 2014, 2 pages.

European Patent Office Application Serial No. 13185687.4, Search Report dated Jun. 10, 2014, 9 pages.

Japan Patent Office Application Serial No. 2013-198043, Office Action dated May 8, 2014, 3 pages.

* cited by examiner

ELECTROMAGNETIC SWITCHING DEVICE

CROSS-REFERENCE TO RELATED APPLICATIONS

Pursuant to 35 U.S.C. §119(a), this application claims the benefit of earlier date and right of priority to Korean Patent Application No. 10-2013-0017219, filed on Feb. 18, 2013, the contents of which is incorporated by reference herein in its entirety.

BACKGROUND

The embodiment relates to an actuating part of an electromagnetic switching device and an electromagnetic switching device including the same.

An electromagnetic switching device is an electric switch device serving as a connection converter to switch on/off a main circuit according to tiny variation of an input current. In the electromagnetic switching device, a contact point is moved by electromagnetic force so that current is applied or shut off.

FIG. 1 is a view illustrating an electromagnetic switching device according to the related art.

The electromagnetic switching device shown in FIG. 1 includes a housing 1, a fixed contact point 2 disposed at an upper portion in the housing 1, and a movable contact point 3 disposed under the fixed contact point 2 and repeatedly making contact with or separated from the fixed contact point 2.

The movable contact point 3 is coupled with a shaft 7 and moves up and down, and a movable core 6 is coupled with an outer peripheral surface of the shaft 7. A fixed core 4 is placed at an upper outer side of the movable core 6, and a coil 5 is disposed at outer sides of the movable core 6 and the fixed core 4.

Further, the fixed core 4 include an upper fixed core 4*a* and a lower core 4*b*.

In addition, a return spring 9 is provided above the shaft 7.

An elastic member 8 is placed at a bottom surface of the housing 1 under the shaft 7 and the movable core 6.

Accordingly, if an electric current is applied to the coil 5, a driving force is applied to the movable core 6 so that the movable core 6 moves up together with the shaft 7 while pushing the shaft 7, thereby making the fixed contact point 2 contact with the movable contact point 3.

Meanwhile, if the current applied to the coil 5 is shut off, the shaft 7 moves down while being pressed by the return spring 9, and the descended shaft 7 and movable core 6 collide with the elastic member 8.

The elastic member 8 absorbs shock caused by collision between the shaft 7 and the movable core 6.

In the electromagnetic switching device of the related art having a structure as described above, when a current does not flow through the coil 5, a bottom end of the upper fixed core 4*a* is spaced apart from a top end of the movable core 6 by a distance A.

If the distance A is too long, an ascending force of the movable core becomes weak. If the distance A is too short, the movable core rapidly starts to move up with insufficient ascending force so that electric connection may not be achieved between the movable contact point and a driving contact point.

Accordingly, the distance A between the movable core 6 and the upper fixed core 4*a* must be appropriately maintained by a magnetic force generated from the coil.

However, if the internal temperature is increased due to the operation of the electromagnetic switching device, a generated magnetic force becomes weak so that there is a need to reduce the distance A between the fixed core and the movable core.

SUMMARY

The disclosure provides an electromagnetic switching device capable of reducing a distance between a movable core and an upper fixed core when the temperature is increased by using a property of an elastic member where a vertical volume of the elastic member provided at a bottom end of a shaft expands as the temperature is increased.

According to one embodiment, there is provided an electromagnetic switching device including: a shaft coupled with a movable contact point to reciprocate up and down; and an elastic member coupled with a bottom end of the shaft, wherein a vertical volume of the elastic member expands as a temperature is increased.

An elastic member receiving part may be provided at a lower portion of the shaft, and the elastic member may be received in the elastic member receiving part such that a top end of the elastic member makes contact with a top surface of the elastic member receiving part to limit volume expansion in an upward direction.

A bottom surface of the elastic member may be asymmetric.

The elastic member may include a rubber.

The electromagnetic switching device may further include a fixed core to surround an outer side of the shaft, wherein the fixed core comprises an upper fixed core and a lower fixed core vertically spaced apart from each other, the shaft comprises a large diameter portion and a small diameter portion provided below the large diameter portion, the movable core is provide at an outer side of the small diameter portion, and the upper fixed core surrounds an outer side of the large diameter portion.

The elastic member receiving part may include a space formed by a bottom end of the shaft and an inner peripheral surface of the movable core, and a top end of the elastic member is partially inserted into the elastic member receiving part.

The electromagnetic switching device may further include a reversed T-shape supporter coupled with the elastic member receiving part, wherein a bottom surface of the elastic member receiving part for limiting upward expansion of the elastic member serves as a bottom surface of the T-shape supporter when the T-shape supporter is coupled with the elastic member receiving part.

According to the embodiment, an appropriate driving force can be provided to the actuating part even if a magnetic force becomes weak by ascending a location of the movable core as a temperatures is increased.

BRIEF DESCRIPTION OF THE DRAWINGS

FIG. 1 is a sectional view illustrating an electromagnetic switching device according to the embodiment.

DETAILED DESCRIPTION OF THE EMBODIMENTS

Figure 1:
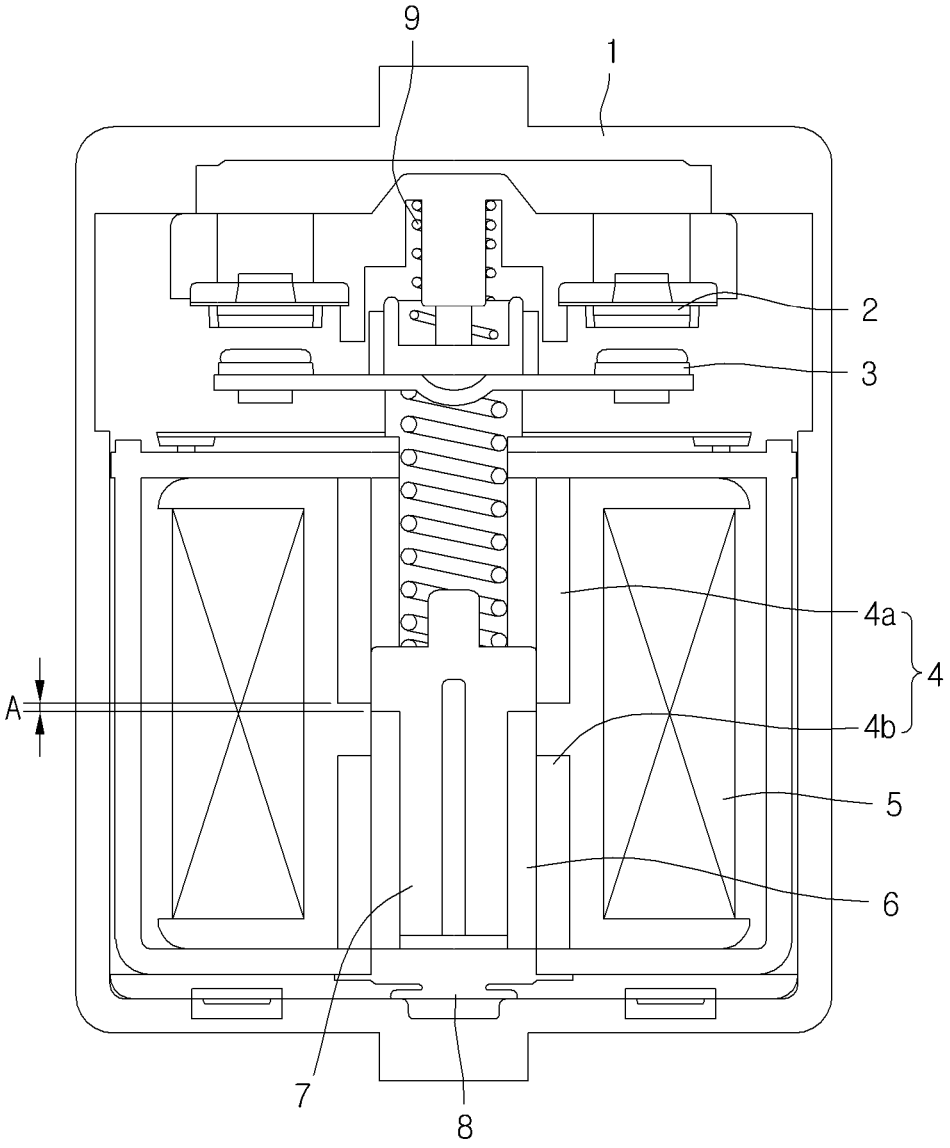
FIG. 1 is a sectional view illustrating an electromagnetic switching device according to the related art.

Hereinafter, an electromagnetic switching device according to the embodiment will be described with reference to accompanying drawings in detail.

The electromagnetic switching device according to the embodiment includes a housing 10, an upper assembly 100 placed at an upper portion in the housing 10, and lower assemblies 200 and 300 placed at a lower portion in the housing 10.

The housing 10 surrounds an outmost portion of the electromagnetic switching device according to the embodiment and receives the upper assembly 100 and the lower assemblies 200 and 300 therein.

Hereinafter, the structure of the upper assembly 100 will be primarily described and then the structure of the lower assemblies 200 and 300 will be described.

The upper assembly 100 includes an upper fixed part 110, a fixed contact point 120, and a return spring 130.

The upper fixed part 110 includes a return spring coupling part 111, a return spring coupling protrusion 112, a guide part 113, and an intermediate part 114.

The return spring coupling part 111 has a substantially cylindrical groove shape which is open downward. Accordingly, the return spring coupling protrusion 112 having a substantially cylindrical shape protruding downward is provided at a center of the spring coupling part 111.

The top end of the return spring 130 to be described later is fitted around an outer side of the return spring coupling protrusion 112. That is, the top end of the return spring 130 is fitted around the return spring coupling part 111 having a substantially cylindrical groove shape.

The guide part 113 extending downward is provided at an outer side of the return spring coupling part 111. The guide part 113 receives the top end of the shaft 310 to be described later, and has a shape corresponding to the top end of the shaft 310 so that the top end of the shaft 310 may slide up and down inside the guide part 113.

Meanwhile, the intermediate part 114, which is a plane facing downward, is provided between the guide part 113 and the return spring coupling part 111. The intermediate part 114 makes contact with the top end of the shaft 310 as the shaft 310 moves up so that the intermediate part 114 may serve as a limiter for limiting the upward movement of the shaft 310. In the embodiment, the limiter signifies a configuration making contact with the shaft 310 to prevent the shaft 310 from moving up any more.

Accordingly, if the return spring coupling protrusion 112 extends downward such that the bottom end of the return spring coupling protrusion 112 makes contact with a bottom surface of a return spring receiving part 314 of the shaft 310 before the top end of the shaft 310 makes contact with the intermediate part 114, the return spring coupling protrusion 112 may serve as the limiter.

The fixed contact point 120 is placed at an outer side of the upper fixed part 110. The fixed contact point 120 includes a conductive material.

As described above, the top end of the return spring 130 is fitted around the return spring coupling part 111, and the bottom end of the return spring 130 is supported by the return spring receiving part 314 in the shaft 310 to be described later so that the return spring 130 can always press the shaft 310 downward.

Hereinafter, a configuration of the lower assemblies 200 and 300 disposed under the upper assembly 100 will be described.

The lower assemblies 200 and 300 include a driving part 200 to provide a driving force according to a current applied from the outside and an actuating part 300 moving up and down according to the driving force from the driving part 200.

First, a configuration of the driving part 200 will be described. The driving part 200 according to the embodiment includes a yoke 210, a bobbin 220 provided in the yoke 210, a coil 230 wound around the bobbin 220, and a fixed core 240 coupled with an inner peripheral surface of the bobbin 220.

The yoke 210 is received in the housing 10, and the bobbin 220 is placed at an inner side of the yoke 210.

The coil 230 is wound around the bobbin 220 and the bobbin 220 includes a protrusion 221 with an intermediate part having a substantially hollow cylindrical shape and protruding from a longitudinal center point to an inner hollow part.

As described above, the coil 230 is wound around an outer side of the bobbin 220 and generates a driving force to ascend the actuating part 300 by generating a magnetic force according to an electrical signal.

A fixed core 240 is coupled with an inner side of the bobbin 220. The fixed core 240 has a substantially hollow cylindrical shape, and includes an upper fixed core 240*a* disposed at an upper portion based on the protrusion 221 and a lower fixed corer 240*b* disposed at a lower portion based on the protrusion 221.

Accordingly, the upper fixed core 240*a* is vertically spaced apart from the lower fixed core 240*b*.

In this case, a bottom end of the upper fixed core 240*a* disposed above the protrusion 221 makes contact with a top surface of the protrusion 221, and a top end of a lower fixed core 240*b* disposed below the protrusion 221 makes contact with a bottom surface of the protrusion 221.

In this case, an inner end of the protrusion of the bobbin 220 is aligned on the same line with an inner side of the fixed core 240 or located inward than the inner side of the fixed core 240. That is, the protrusion 221 protrudes corresponding to or more than the thickness of the fixed core 240.

Hereinafter, a configuration of the actuating part 300 will be described.

The actuating part 300 includes a shaft 310 that reciprocates up and down, a movable contact 320 coupled with the shaft 310 and including a movable contact point 321, a movable core 330, a wipe spring 340, and an elastic member 350.

The shaft 310 is disposed at a hollow region in the fixed core 240, and has a substantially cylindrical shape extending up and down.

An outer diameter of an upper part of the shaft 310 is greater than an outer diameter of a lower part of the shaft 310, and a stepped surface facing downward is formed at the part where the outer diameter varies. Accordingly, an upper portion becomes a large diameter portion 311, and a lower portion becomes a small diameter portion 312 based on the stepped surface. The stepped surface becomes a pressing surface 313 making contact with an upper end of the movable core 330 to be described later.

Meanwhile, the top end of the shaft 310 is open, a hollow region having a predetermined depth is formed downward from the top end and the hollow region forms a return spring receiving part 314.

A bottom end of the return spring 130 described above is received and supported in the return spring receiving part 314.

Meanwhile, another hollow region is formed below a bottom surface of the return spring receiving part 314, and the another hollow region becomes a wipe spring receiving part 315. The wipe spring receiving part 315 is formed at an inner side of the large diameter portion 311.

A wipe spring 340 is received in the wipe spring receiving part 315.

Figure 2:
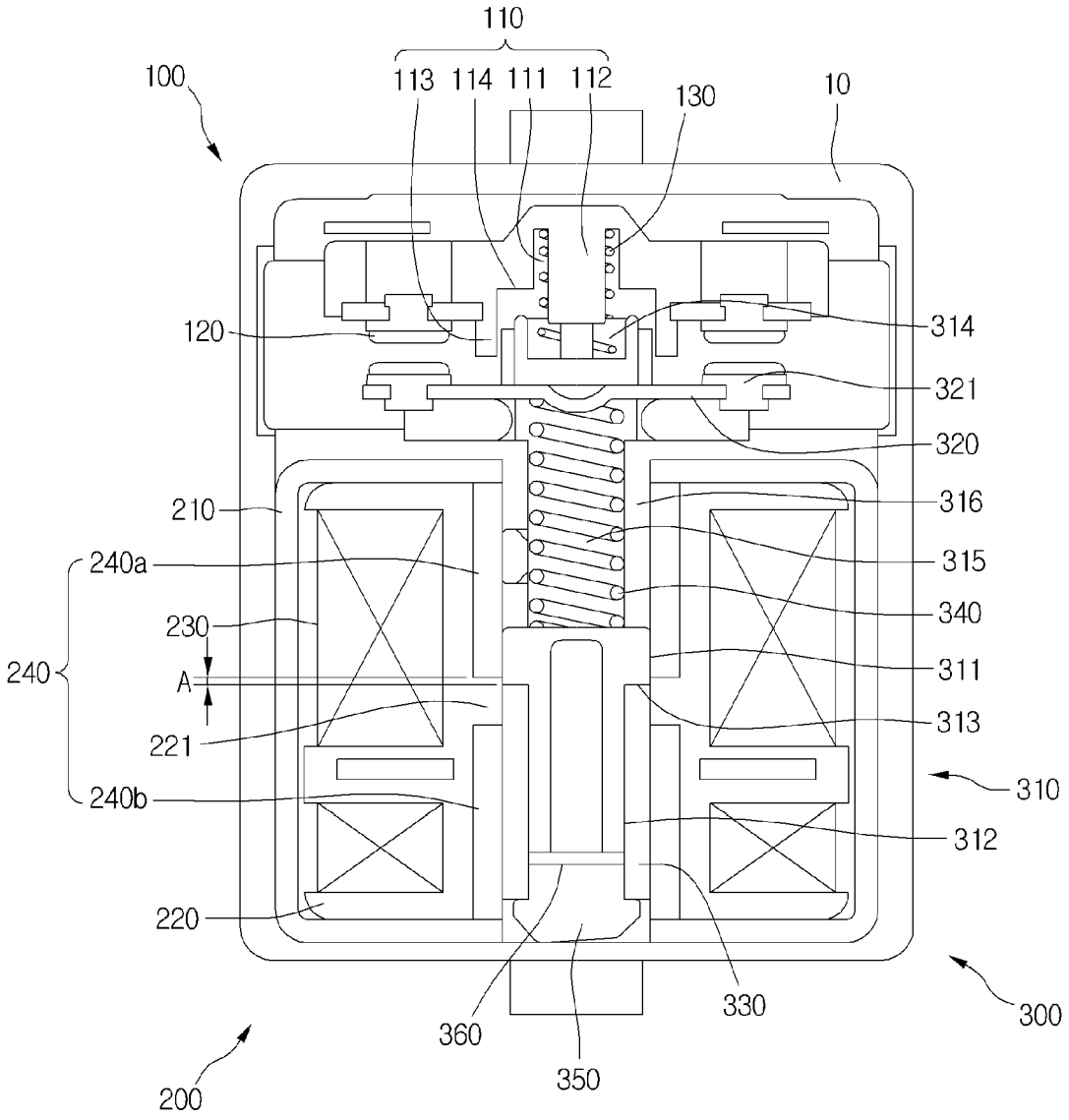
Figure 3:
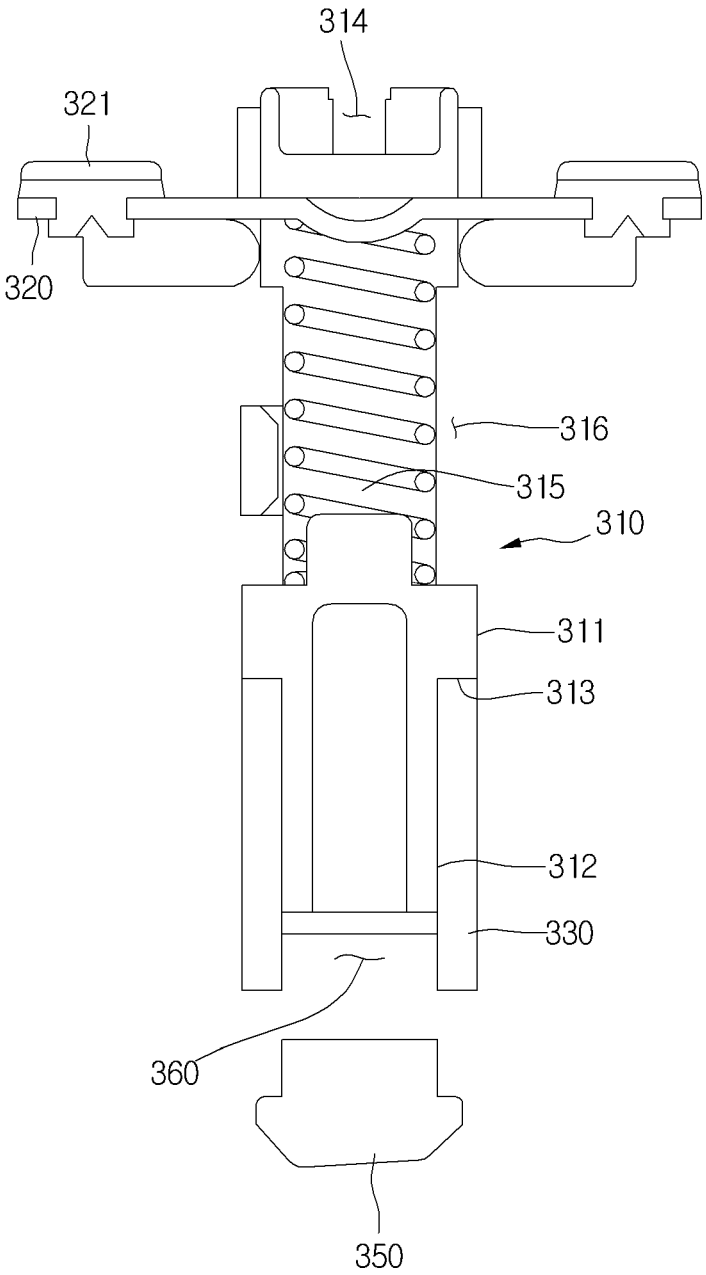
FIG. 3 is a sectional view illustrating a driving part according to the embodiment.
Figure 4:
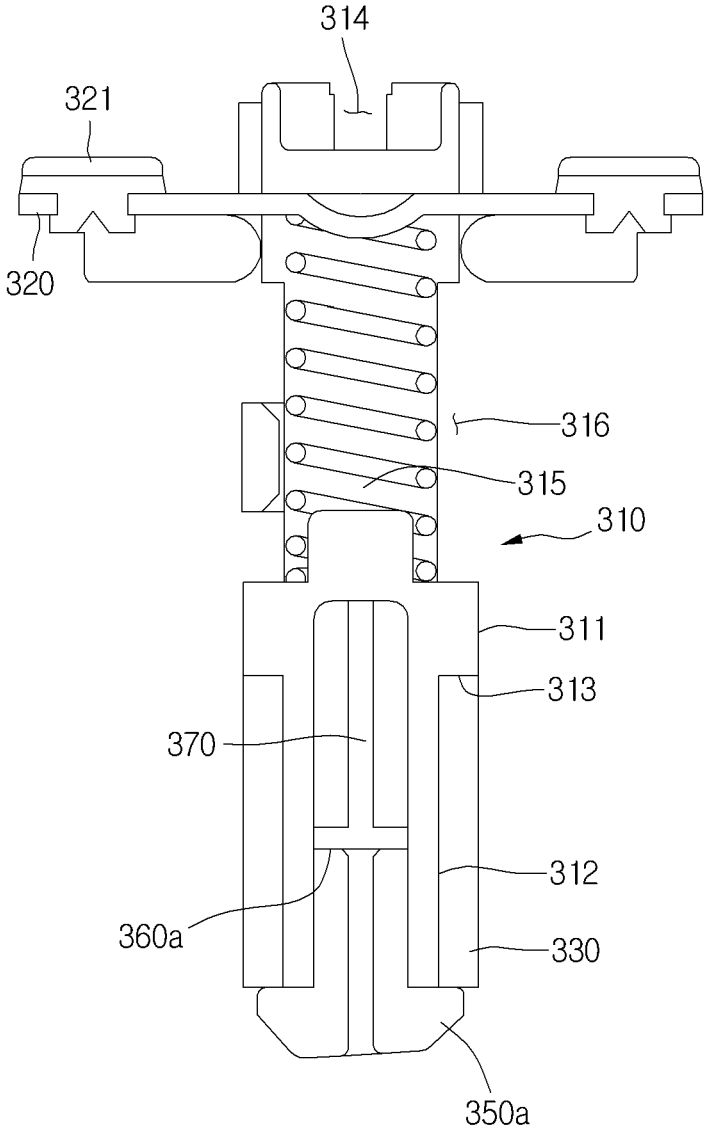
FIG. 4 is a sectional view illustrating a driving part according to another embodiment.

A side of the wipe spring receiving part 315 is partially incised in the length direction so that a cutting part 316 is formed as shown FIGS. 2 to 4. A pair of cutting parts 316 are provided while facing each other.

The cutting part 316 serves as a space in which the movable contact 320 may move up and down.

The movable contact 320 is a conductor having a flat plate shape and the movable contact point 321 is provided thereon. The movable contact 320 may be formed integrally with the movable contact point 321. The movable contact 320 extends by passing through the shaft 310 via the cutting part 316 and the movable contact point 321 is positioned below the fixed contact point 120 to repeatedly make contact with the fixed contact point 120.

The movable contact 320 makes contact with the top end of the wipe spring 340, and is always pressed upward by the wipe spring 340.

The movable core 330 is coupled with an outer side of the small diameter portion 312 of the shaft 310.

A top end of the movable core 330 makes contact with the pressing surface 313. Since the movable core 330 slides in the fixed core 240, an outer diameter of the movable core 330 must be smaller than an inner diameter of the fixed core 240. The outer diameter of the movable core 330 is substantially the same as the outer diameter of the large diameter portion 311.

Accordingly, the small diameter portion 312 becomes a movable core coupling part. Hereinafter, the small diameter portion and the movable core coupling part will be denoted with the same reference numeral 222. That is, reference numeral 222 may refer to the small diameter portion distinguished from the large diameter portion, and may refer to the movable core coupling part coupled with the movable core 330.

Meanwhile, the top end of the movable core 330 is spaced apart from the bottom end of the upper fixed core 4*a* by a distance A under the upper fixed core 4*a*.

The elastic member 350 is coupled with a lower end of the shaft 310 as shown in FIGS. 2 and 3. When the movable part 300 descends, the elastic member 350 absorbs shock from a bottom surface of the housing 10.

The elastic member 350 extend up and down and is coupled with the elastic member receiving part 360 provided at a lower portion of the shaft 310.

The elastic member receiving part 360 is a space formed by the bottom end of the shaft 310 and an inner peripheral surface of the movable core 330, and the top end of the elastic member 350 is partially inserted into the space.

The elastic member 350 may include a material having expansion and elastic properties in which a volume of the material expands as the temperature is increased, for example, the elastic member 350 may include a rubber.

The top surface of the elastic member 350 makes contact with a top surface of the elastic member receiving part 360 to limit upward expansion of a volume upon thermal expansion.

If the volume of the elastic member 350 expands due to the temperature increase, the length of the elastic member 350 is increased up and down. In this case, since the volume change is limited in the upward direction, the length change is realized in the downward direction, so that volume change is relatively increased in the downward direction.

Accordingly, if the temperature of the elastic member 350 is increased in a state shown in FIGS. 2 and 3, heights of the shaft 310 and the movable core 330 can be efficiently increased.

FIG. 4 illustrates another example of the elastic member 350*a* and the elastic member receiving part 360*a*.

In the present embodiment, a bottom end of the shaft 310 is open in a hollow state. A substantially reversed T-shape supporter 370 is inserted into the open region, and a hollow part under the supporter 370 becomes the elastic member receiving part 360*a*.

The elastic member 350*a* inserted into the elastic member receiving part 360*a* also makes contact with the T-shape supporter 370 so that volume change may be concentrated onto the lower portion. Accordingly, when the T-shape supporter 370 is coupled with the elastic member receiving part 360*a*, a bottom surface of the elastic member receiving part 360*a* that restricts upward expansion of the elastic member 350 may become a bottom surface of the T-shape supporter 370. For reference, the reversed T-shape signifies the turn-over of the alphabet T.

In this case, the elastic member 350*a* is provided therein with a hollow part longitudinally formed through a central region of the elastic member 350*a*.

Meanwhile, the elastic member 350*a* may extend to the extent of the end portion of the hollow part without the T-shape supporter.

Meanwhile, the reason to increase heights of the shaft 310 and the movable core 330 in the high temperature condition is as follows.

If an electric current is applied to the coil 230, the movable core 330 is subject to an ascending force. In this case, if a distance between the bottom end of the upper fixed core 240*a* and the top end of the movable core 330 is too long, the ascending force of the movable core 330 becomes weak. If the distance between the bottom end of the upper fixed core 240*a* and the top end of the movable core 330 is too short, the movable core 330 rapidly starts to move up so that the ascending force is insufficient. In this case, the movable contact point 321 may not make contact with the fixed contact point 120.

Accordingly, the distance between the movable core 330 and the upper fixed core 240*a* must be appropriately maintained according to a magnetic force generated by the coil 230.

However, if the internal temperature is increased due to the operation of the electromagnetic switching device, a generated magnetic force becomes weak so that the distance A between the upper fixed core 240*a* and the movable core 330 must be reduced to allow the movable core 330 to have an appropriate ascending force.

In the electromagnetic switching device according to the embodiment, a property of an elastic member 350, which is expanded as the temperature is increased, is used in order to reduce the distance between the upper fixed core and the movable core upon the increase of the temperature. As described above, the elastic member may include a rubber.

Meanwhile, the elastic members 350 and 350*a* preferably have asymmetric bottom surfaces. Upon ascending and descending, the elastic members 350 and 350*a* do not perpendicularly move up and down, but ascend and descend while colliding with an inner side of the fixed core 240 to the left and right. Although it may rarely happen, the shaft 310 may perpendicularly move down exactly.

In this case, since the bottom end of the shaft 310 collides with the bottom surface of the housing 10 so that the bottom end of the shaft 310 is perpendicularly bounced again, a strong ascending force may be generated due to a repulsive force so the fixed contact point 120 may unintentionally make contact with the movable contact point 321.

For this reason, the bottom surfaces of the elastic members 350 and 350*a* are asymmetrically formed. In this case, although it may rarely happen, when the shaft 310 perpendicularly moves down exactly, the shaft 310 does not perpendicularly move up exactly, but collide with a side of the fixed core 240 to the left and right while moving up, so that the movement speed of the shaft 310 may be reduced.

For reference, in FIGS. 2 to 4, although the shaft 310 and the movable core 330 are illustrated as if they make surface-contact with the fixed core 240, a small gap is formed therebetween to allow the shaft 310 and the movable core 330 to collide with the fixed core 240 to the left and right.

Hereinafter, an operation of the electromagnetic switching device having a structure as mentioned above will be described.

The shaft 310 is always pressed downward, that is, in a direction in which the fixed contact point 120 is away from the movable contact point 321 so that the fixed contact point 120 is spaced apart from the movable contact point 321.

In this state, if a current is applied to the coil 230, the movable core 330 has a driving force to move up and down due to a magnetic flux generated by the coil 230.

The movable core 330 ascends due to the driving force. The move core 330 ascends while pressing the pressing surface 313 of the shaft 310 upward to ascend the shaft 310.

If the shaft 310 ascends, the movable contact point 321 makes contact with the fixed contact point 120. After the movable contact point 321 makes contact with the fixed contact point 120, the shaft 310 further ascends and the upper end of the shaft 310 makes contact with the intermediate part 114, so that the ascending of the shaft 310 is terminated.

Meanwhile, if power supply to the coil 230 is shut off, the shaft 310 moves down due to an elasticity force of the return spring 130.

During the above procedure, if the internal temperature of the device is increased, the vertical volume of the elastic members 350 and 350*a* expands, so that the distance A between the upper fixed core 240 and the movable core 330 is reduced. Accordingly, a driving force applied to the movable core 330 is compensated for.

When the shaft 310 ascends or descends, the shaft 310 collides with the fixed core 240 while moving upward. In this case, the shaft 310 may perpendicularly move down exactly although it may rarely happen.

In this case, since the bottom surfaces of the elastic members 350 and 350*a* are asymmetrically formed, the shaft 310 colliding with the bottom surface of the housing 10 is not perpendicularly bounced upward exactly, but moves up while colliding to the left and right. Accordingly, the ascending speed may be limited so that undesirable contact between the fixed contact point 120 and the movable contact point 321 can be prevented.

What is claimed is:

1. An electromagnetic switching device comprising:

a shaft coupled with a movable contact point such that the shaft moves up and down, the shaft comprising a large diameter portion and a small diameter portion below the large diameter portion;

an elastic member coupled with a bottom end of the shaft and having an asymmetric bottom surface;

a fixed core surrounding an outer side of the shaft, the fixed core comprising an upper fixed core that surrounds an outer side of the large diameter portion of the shaft and a lower fixed core vertically spaced apart from the upper fixed core; and a movable core at an outer side of the small diameter portion of and coupled with the outer side of the shaft, wherein a vertical volume of the elastic member expands as temperature is increased.

2. The electromagnetic switching device of claim 1, further comprising:

an elastic member receiving part at a lower portion of the shaft, wherein the elastic member is received in the elastic member receiving part such that a top end of the elastic member makes contact with a top surface of the elastic member receiving part to limit volume expansion of the elastic member in an upward direction.

3. The electromagnetic switching device of claim 1, wherein the elastic member comprises rubber.

4. The electromagnetic switching device of claim 2, wherein:

the elastic member receiving part comprises a space formed by the bottom end of the shaft and an inner peripheral surface of the movable core; and a top end of the elastic member is partially inserted into the elastic member receiving part.

5. The electromagnetic switching device of claim 4, further comprising a reversed T-shape supporter coupled with the elastic member receiving part such that a bottom surface of the elastic member receiving part provides a bottom surface of the T-shape supporter.

* * * * *